US006196860B1

(12) United States Patent
Okayasu et al.

(10) Patent No.: US 6,196,860 B1
(45) Date of Patent: Mar. 6, 2001

(54) CONNECTOR

(75) Inventors: Yasushi Okayasu; Yukimasa Motomatsu; Hitoshi Okumura; Toshikazu Sakurai; Izumi Suzuki, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/198,344

(22) Filed: Nov. 24, 1998

(30) Foreign Application Priority Data

Nov. 26, 1997 (JP) ..... 9-324859
Dec. 9, 1997 (JP) ..... 9-338517

(51) Int. Cl.[7] ..... H01R 11/20
(52) U.S. Cl. ..... 439/404; 439/395
(58) Field of Search ..... 752/395, 352, 752/288, 286, 595, 752, 404, 459, 456

(56) References Cited

U.S. PATENT DOCUMENTS

| | | | | |
|---|---|---|---|---|
| 3,824,530 | | 7/1974 | Roberts et al. | 339/99 R |
| 4,066,316 | * | 1/1978 | Rolings | 339/91 R |
| 4,343,085 | | 8/1982 | Lucius et al. | 29/866 |
| 4,380,361 | | 4/1983 | Asick et al. | 339/91 R |
| 5,573,432 | | 11/1996 | Hatagishi | 439/752 |
| 5,702,265 | * | 12/1997 | Yamaguchi | 439/352 |
| 5,775,930 | * | 7/1998 | Model et al. | 439/352 |
| 5,915,990 | * | 6/1999 | Beer et al. | 439/417 |
| 5,947,763 | * | 9/1999 | Alaksin | 439/489 |

FOREIGN PATENT DOCUMENTS

| | | |
|---|---|---|
| 0 470 887 | 7/1991 | (EP) . |
| 60-240072 | 11/1985 | (JP) . |
| 62-198063 | 9/1987 | (JP) . |

* cited by examiner

*Primary Examiner*—Paula Bradley
*Assistant Examiner*—Alexander Gilman
(74) *Attorney, Agent, or Firm*—Banner & Witcoff, Ltd.

(57) ABSTRACT

To prevent an electric wire cover from being attached upside down, ribs 16 and 24 are formed respectively on the outer peripheral upper face of a housing 10 and the inner peripheral lower face of an electric wire cover 20. Two wire distribution spaces 36U and 36L are provided between the housing 10 and the electric wire cover 20, extending along the upper and lower faces of the housing 10. When the electric wire cover 20 is correctly attached, the ribs 16 and 24 of the housing 10 and the electric wire cover 20 do not interfere with one another. However, when the electric wire cover 20 is upside down, the ribs 16 and 24 interfere with one another, thereby preventing the attachment of the electric wire cover 20.

13 Claims, 9 Drawing Sheets

FIG. 2
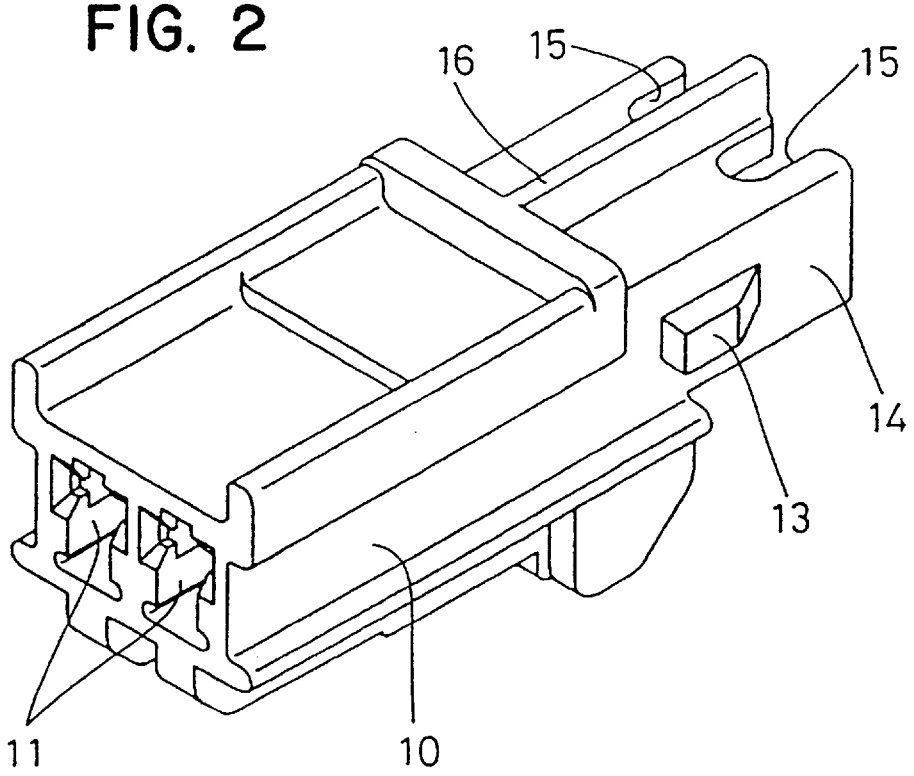
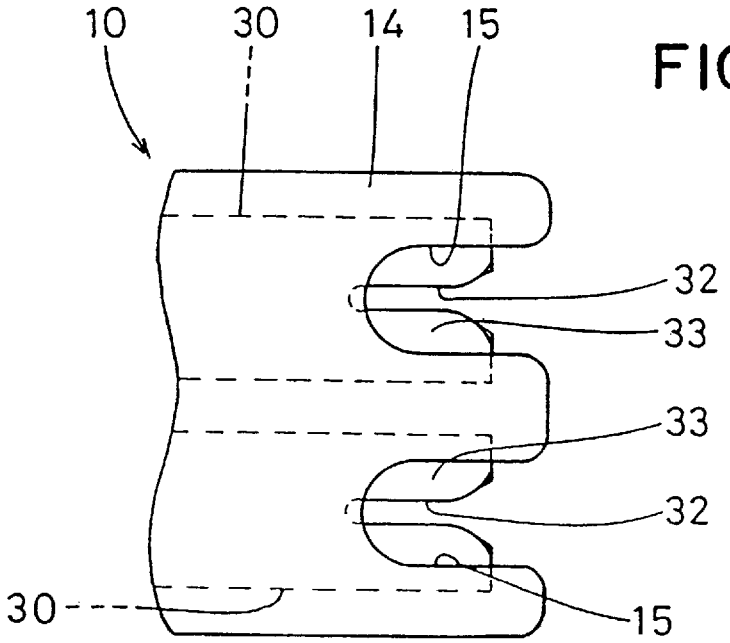
FIG. 3

CONNECTOR

TECHNICAL FIELD

The present invention relates to a connector provided with a cover for electric wires.

BACKGROUND TO THE INVENTION

As shown in FIG. 9, a conventional example of a connector provided with a cover for electric wires comprises terminal fittings 2 inserted into a housing 1, an electric wire 4 attached by pressure contact to a pressure contact blade 3 at the posterior end of each terminal fitting 2, and a cover 5 attached to the housing 1 to cover the pressure contact portion thereof.

The portions of the electric wire 4 which extend upwards and downwards from the pressure contact blade 3 are respectively bent in an anterior direction so as to lead out through a space between an outer peripheral face of the housing 1 and an inner peripheral face of the cover 5, and are then folded back and distributed along the outer peripheral face of the cover 5. The electric wires 4 are then gathered together with tape 6 into a bundle at the posterior of the cover 5.

In this connector, a distribution space 7 is required for the electric wires 4 in between the outer face of the housing 1 and the inner face of the cover 5. Accordingly, ribs 8 are provided on the inner face of the cover 5, and these make contact with the outer face of the housing 1, thereby defining the distribution space 7. However, the ribs 8 are formed only on the cover 5, and there is the danger that, in the case where the end faces of the housing 1 and cover 5 are square and a position fixing means has not been provided, the cover 5 may be attached to the housing 1 upside down.

The present invention has been developed after taking the above problem into consideration, and in a first aspect aims to present a means of preventing the electric wire cover 5 from being attached incorrectly to the housing 1.

FIG. 10 illustrates another problem with the prior art device. Conventionally the cover 5 is attached to the housing 1 by a flexible locking arm 9 which engages a projection of a mating connector housing. In order to release the cover 5, the locking arm 9 is depressed. In order to prevent accidental release of the locking arm 9 by contact with another structure, side walls 10 are provided. These walls require a finger to be inserted between them so as to depress the locking arm. However, due to miniaturisation, the space between the walls may be too small to allow the locking arm to be depressed, and accordingly operability is reduced.

The present invention also aims to provide a solution to this problem.

SUMMARY OF THE INVENTION

According to a first aspect, the invention provides an electrical connector comprising a housing, a terminal fitting within said housing and having a protruding end for engagement with an electrical wire, and a cover for said protruding end, said cover and housing defining a wire distribution space therebetween, wherein said cover and housing have opposed projections adapted to prevent said cover being fitted upside down on said housing.

Such a connector ensures that the cover cannot be filled upside down, and thus trap or otherwise damage the electrical wires enclosed thereby.

Preferably the projections comprise upstanding and depending ribs of the cover and housing, and each rib may define a wire distribution space on either side thereof. In this way the ribs can serve the double function of preventing incorrect fitting of the cover, and separating adjacent wires. The cover may include a planar projection which, in conjunction with the rib of the housing, can define a wire distribution space more precisely.

In a second aspect, the invention provides an electrical connector comprising a housing, a terminal fitting in the housing and having a protruding end for engagement with an electrical wire, and a cover for said protruding end, said connector further including a resilient cantilevered locking arm of the housing having a protrusion engageable with an abutment of a mating connector, said housing having upstanding walls on either side of said arm to prevent accidental depression thereof, wherein said walls include a cut-away portion just sufficient to permit depression of said locking arm by a single finger.

Such a connector overcomes a problem of miniaturisation whereby a finger cannot fit between the walls in order to depress the locking arm.

The locking arm may extend over the cover in use, and the cover may also include upstanding protective walls. The finger recess may be provided at the junction of the housing and cover, and be partially provided on the cover and partially on the housing. The upstanding walls of the cover preferably have the second function of providing a guide channel to guide wires from the housing away therefrom.

BRIEF DESCRIPTION OF DRAWINGS

Other aspects of the invention will be apparent from the following description of a preferred embodiment shown by way of example only in the accompanying drawings, in which:

FIG. 2 is a diagonal view showing a housing upside down.

FIG. 3 is a partial plan view showing the positional relationship of pressure contact blades in the housing.

DESCRIPTION OF PREFERRED EMBODIMENT

Figure 1:
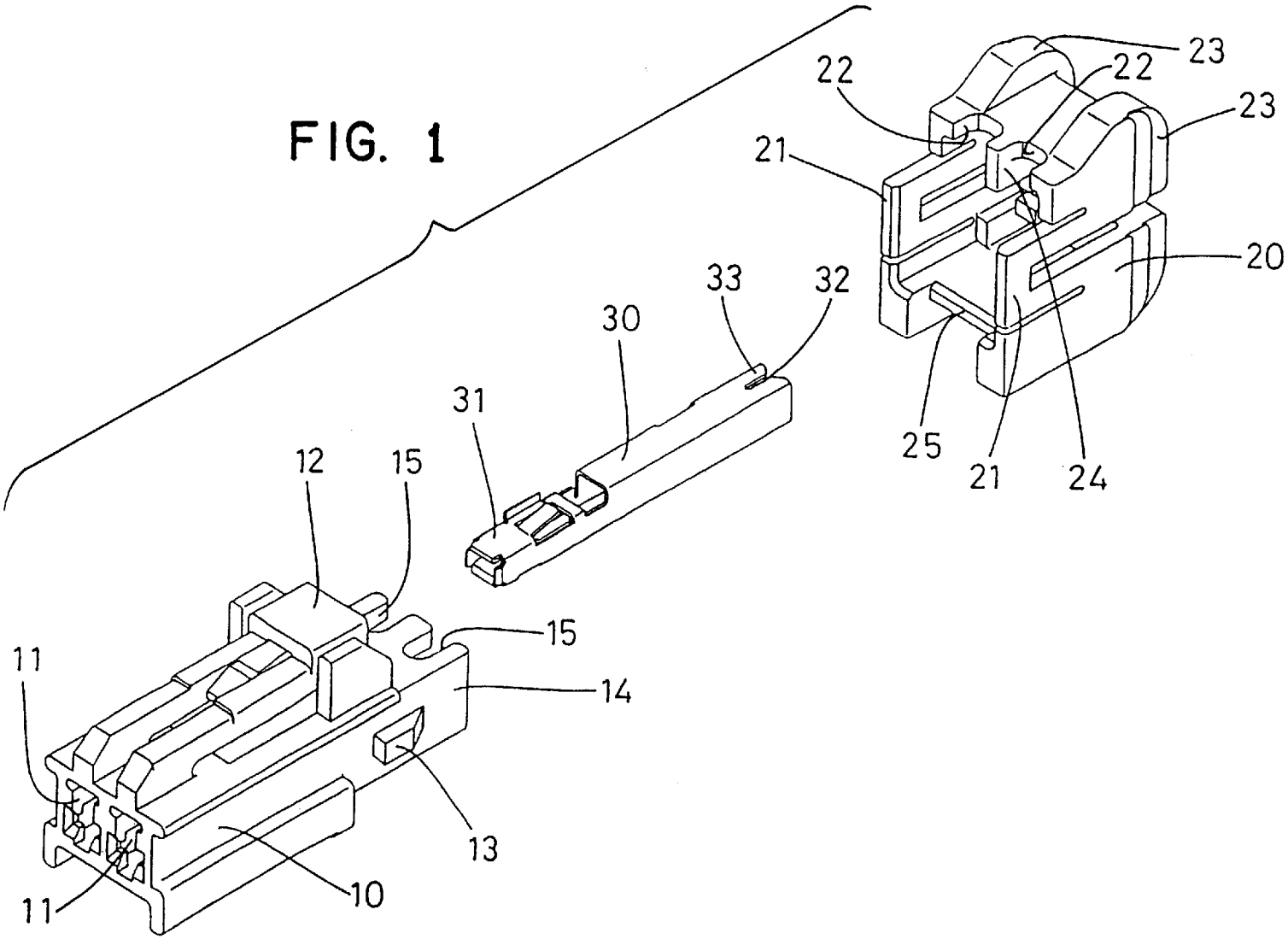
FIG. 1 is a diagonal view showing an embodiment of the invention in a disassembled state.
Figure 4:
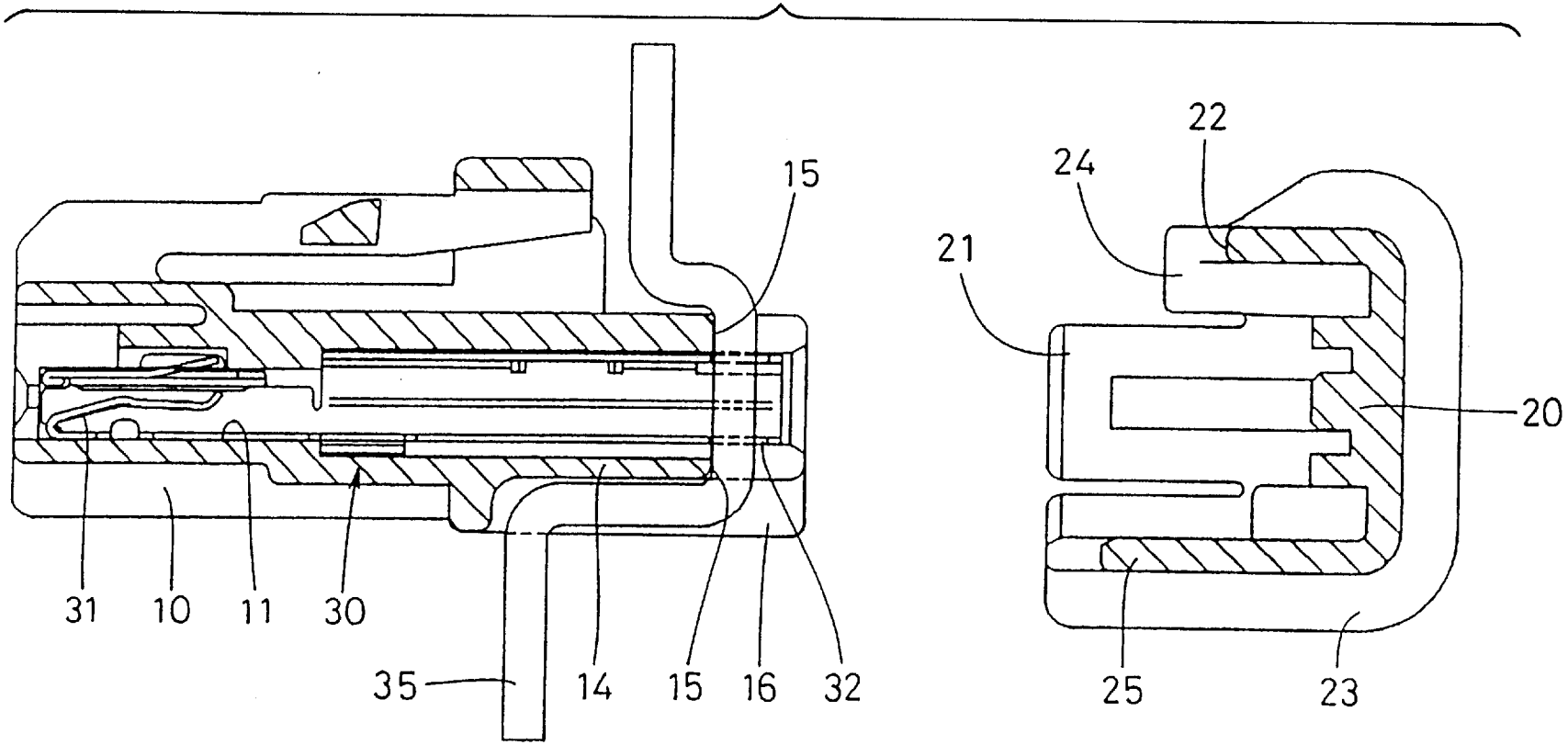
FIG. 4 is a cross-sectional view showing an electric wire cover in a separated state.

An embodiment of the first aspect of the present invention is explained below with the aid of FIGS. 1 to 8.

A connector is provided with a housing 10, an electric wire cover 20 and terminal fittings 30. A pair of left and right cavities 11 are formed within the housing 10, these cavities 11 housing the terminal fittings 30 and being open at the anterior and posterior end faces so as to pass through the housing 10. The upper face of the housing 10 has a locking arm 12, this locking the housing 10 in a fitted state with a corresponding connector C (shown by the chain line in FIG. 7). Further, the left and right side faces of the housing 10 are provided with stopping protrusions 13 for latching the cover 20 in an attached state. The posterior end portion of the housing 10 forms an attachment member 14 which is housed within the cover 20, a pair of left and right pressure contact recesses 15 being formed in the upper and lower faces of this attachment member 14. These recesses 15 are cut-away in an anterior direction from the posterior edge of the attachment member 14, and adjoin the cavities 11.

The anterior end of each terminal fitting 30 comprises a connecting member 31 for connecting with male terminal fittings (not shown) of the corresponding connector C, and the posterior end comprises a pressure contact blade 32 for joining with the electric wire 35 by pressure contact. A slit is cut in an anterior direction from the posterior end of a blade 33 of each pressure contact blade 32. The electric wire 35, the axis of which is in an up-down direction, is pushed onto each pressure contact blade 32 from a posterior direction, an insulating covering of the electric wire 35 being cut-away and conductors (not shown) making contact with the pressure contact blade 32. As shown in FIG. 3, these pressure contact blades 32 are arranged so as to correspond to the recesses 15, the innermost end of the slits thereof being located slightly further in than the innermost ends of the recesses 15. That is, the inner ends of the pressure contact blades 32 are hidden within the interior of the cavities 11. As a result, even if the electric wires are pressed deeply into the recesses 15 so as to make contact with the inner ends thereof, the conductors will not be severed.

The electric wire cover 20 is box-like, and is open in the anterior direction, a pair of bending stopping members 21 being formed on the left and right side faces thereof, these stopping members 21 fitting with stopping protrusions 13 of the housing 10. When the cover 20 and the housing 10 are correctly attached, the stopping members 21 and the stopping protrusions 13 fit together, thereby latching the cover 20 in an attached state.

When the cover 20 is in an attached state with the housing 10, a wire distribution space 36U is formed between the inner peripheral upper face of the electric wire cover 20 and the outer peripheral upper face of the attachment member 14, and a wire distribution space 36L is formed between the inner peripheral lower face of the electric wire cover 20 and the outer peripheral lower face of the attachment member 14. Those portions of the electric wires 35 which extend above and below from their pressure contact points are bent in an anterior direction and distributed along these wire distribution spaces 36U and 36L.

Figure 8:
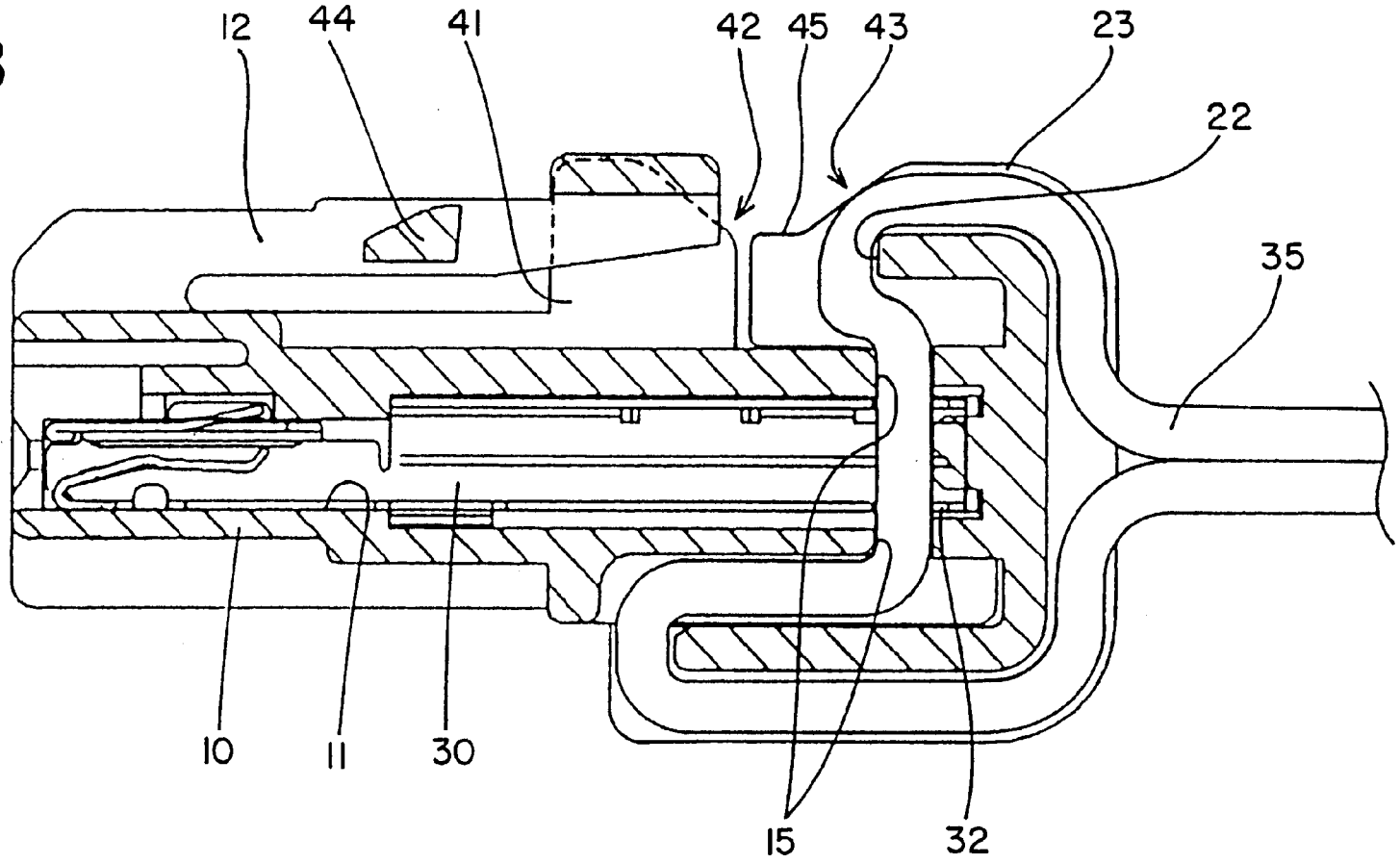
FIG. 8 illustrates the cut-away wall portion adjacent the locking arm.
Figure 9:
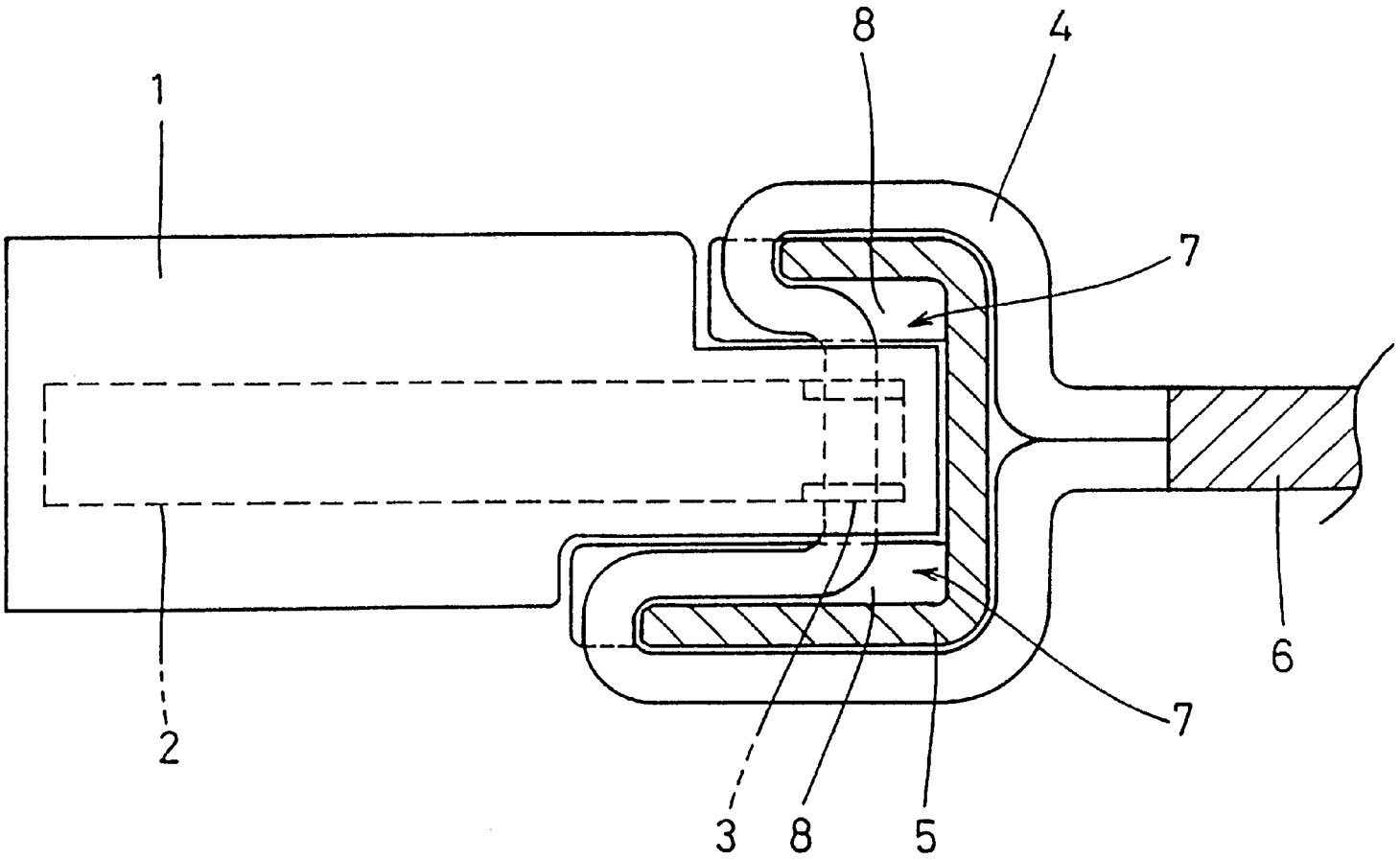
FIG. 9 PRIOR ART
FIG. 9 is a partially cut-away side view showing a prior art example.
Figure 10:
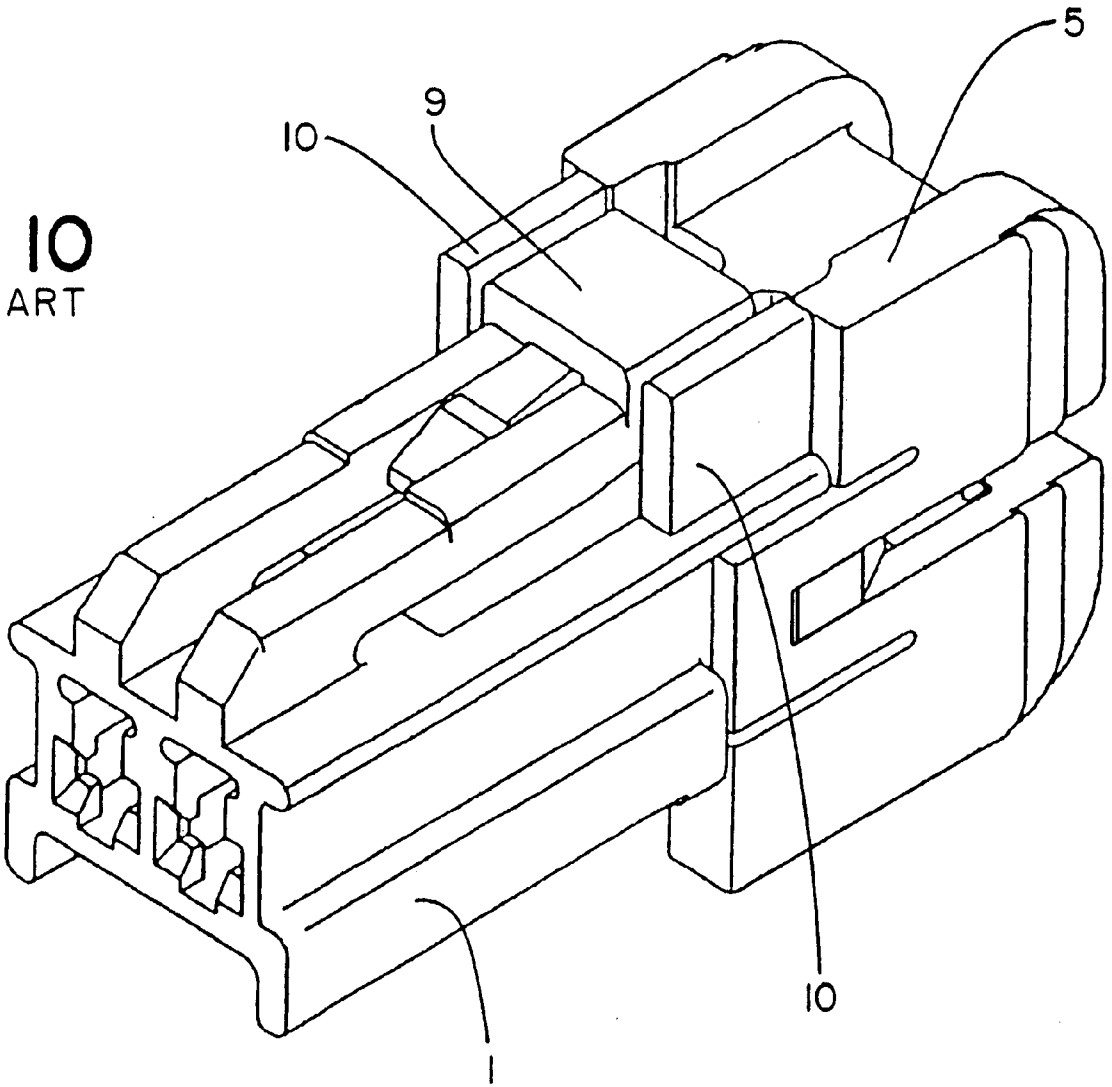
FIG. 10 PRIOR ART
FIG. 10 is a perspective view of a prior art example.

A concave member 22 for folding over the electric wire 35 is formed on the upper face of the electric wire cover 20, this being located anterior to the pressure contact concave members 15 of the housing 10 when the cover 20 in the correctly attached state. As shown in FIG. 8, the electric wire 35, which extends along the wire distribution space 36U, is distributed along the upper face of the cover 20. The electric wire 35 which extends along the lower wire distribution space 36L is also folded over in a posterior direction, and is distributed along the lower face of the cover 20. Finally, this lower electric wire 35 is bound together with the upper electric wire 35 into a bundle with tape (not shown). Electric wire guiding walls 23 protrude from the upper face, posterior face and the left and right sides of the lower face of the cover 20, these guiding walls 23 preventing the electric wires 35 from falling off to the side.

The connector of the present embodiment has wire distribution spaces 36U and 36L to prevent the electric wire 35 from being pressed and crushed, and is provided with a means to prevent the electric wire cover 20 from being attached in an upside down state.

That is, a rib 16 is provided on the outer peripheral lower face of the attachment member 14, this rib 16 protruding in an anterior-posterior direction from a location that is in the centre with respect to a width-wise direction. When the cover 20 is correctly attached, this rib 16 is adjacent to the inner peripheral lower face of the cover 20, thereby maintaining the wire distribution space 36L of the electric wire between the outer face of the attachment member 14 and the inner face of the cover 20.

A rib 24 is provided on the inner peripheral upper face of the cover 20, this rib 24 protruding an anterior-posterior direction from a location (between the concave member 22) that is central with respect to a width-wise direction, like the rib 16. When the cover 20 is correctly attached, this rib 24 is adjacent to the outer face of the attachment member 14, thereby maintaining the wire distribution space 36U of the electric wire between the inner face of the cove 20 and the outer face of the attachment member 14.

Further, these ribs 16 and 24 perform the function of fixing the position in an up-down direction of the electric wire cover 20 relative to the housing 10.

Next, the operation of the present embodiment is explained.

When the electric wire cover 20, facing the correct way, is brought adjacent to the housing 10, the rib 16 and the rib 24 do not interfere with one another, and the cover 20 can be fitted to the housing 10, thereby forming the wire distribution spaces 36U and 36L. Then, when this correctly attached state ha been achieved, the stopping members 21 and the stopping protrusions 13 fit together, latching the cover 20 in an attached state.

Figure 5:
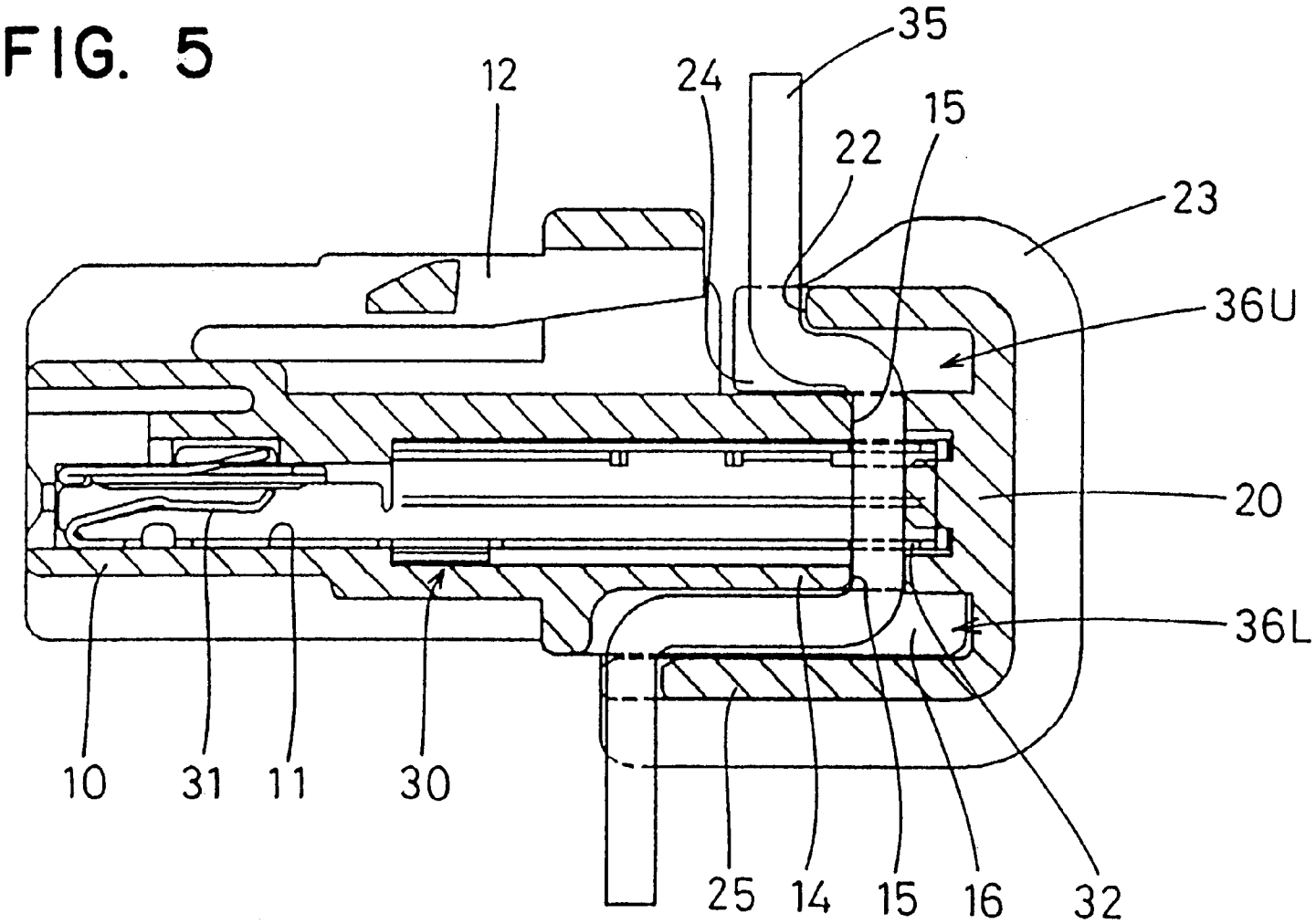
FIG. 5 is a cross-sectional view showing the electric wire cover in an attached state.

When the cover 20 is attached, the electric wire 35 is pushed in by the electric wire cover 20, thereby housing the wire 35 automatically in the wire distribution spaces 36U and 36L (see FIG. 5). At this juncture, the rib 24 divides the two electric wires 35 to the left and right by being wedged into the recesses 15, thereby preventing the wires 35 from becoming crossed or twisted together. On the lower face, the two wires 35 protruding from the recesses 15 are divided to the left and right prior to attachment by the rib 16 thereby also preventing their becoming crossed or twisted together.

Figure 6:
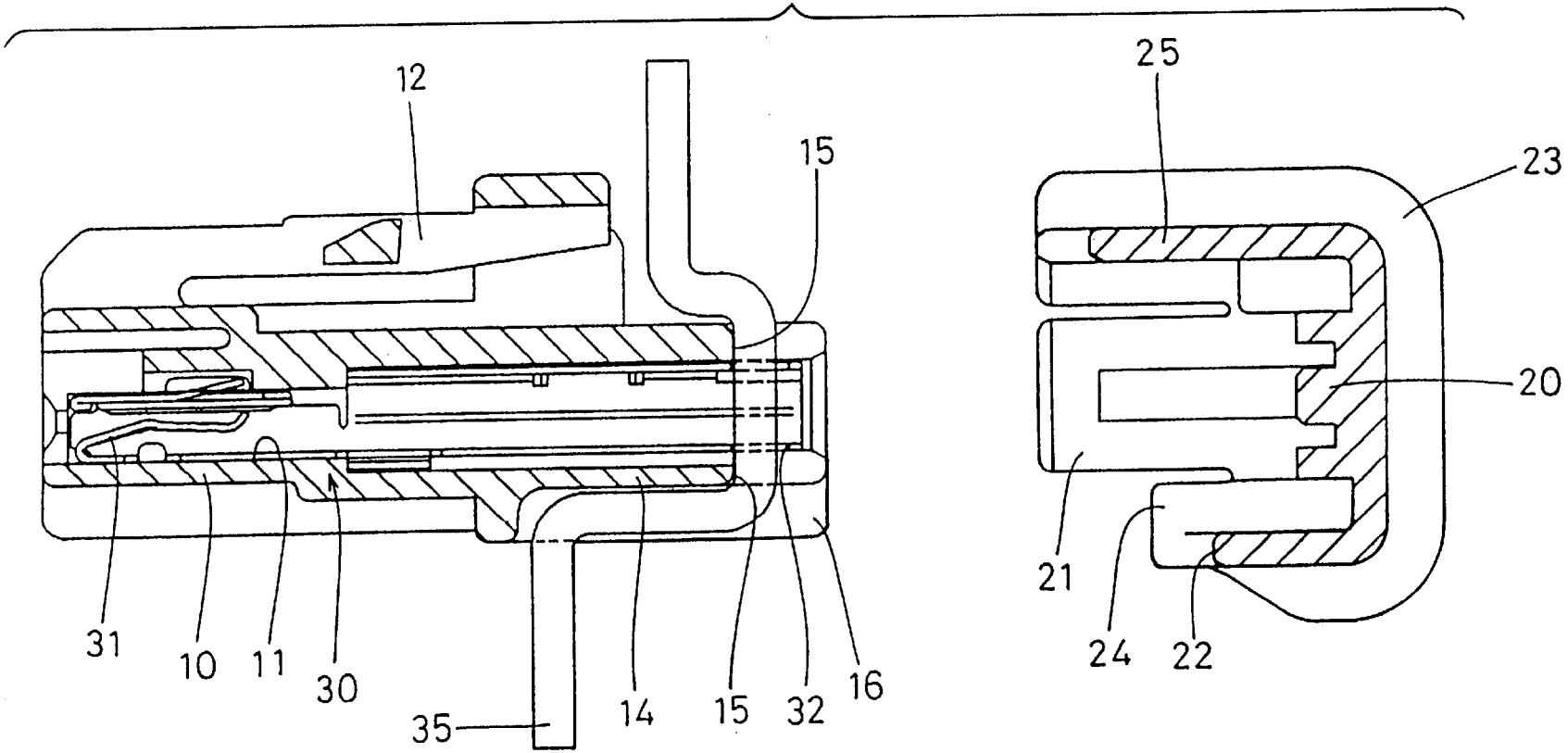
FIG. 6 is a cross-sectional view showing the electric wire cover upside down relative to the housing.

Further, as shown in FIG. 6, in the case where the electric wire cover 20 is about to be attached in an upside down state, the rib 24 is lowest. As a result, the rib 24 faces the rib 16. If the attachment operation were to proceed from this state, the ribs 16 and 24 would strike against one another, and the attachment operation would not be able to be performed. At this point, if the cover 20 were moved downwards, the interference between the ribs 16 and 24 could be avoided. However, a lower face 25 of the cover 20 passes over the wires 35 of the upper face, thus regulating this downwards movement. As a result, the ribs 16 and 24 will strike against one another. In this manner, according to the present embodiment, the upside-down attachment of the electric wire cover 20 can be prevented.

Figure 7:
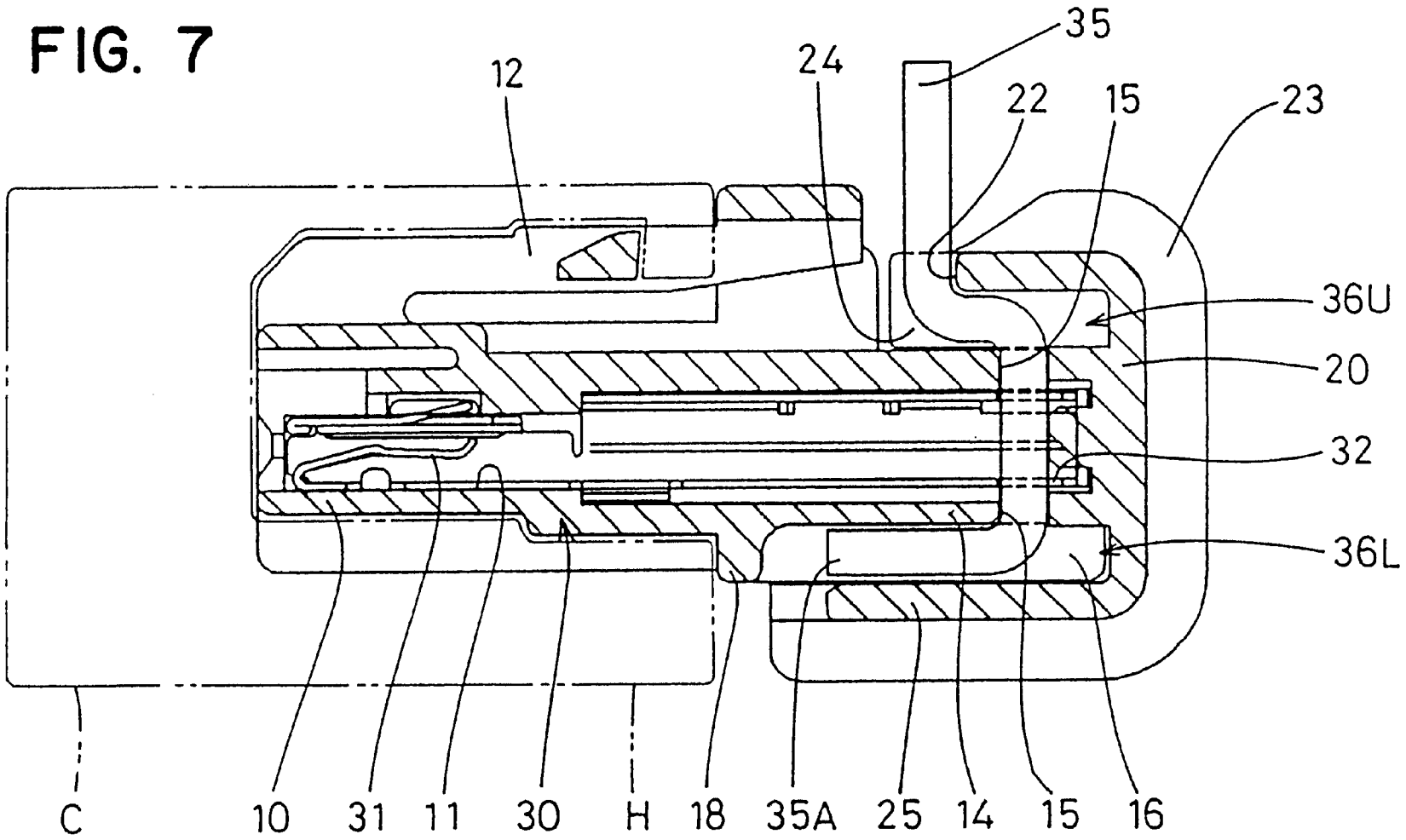
FIG. 7 is a cross-sectional view showing the other application of embodiment 1.

As shown in FIG. 7, the housing 10 (on the left in FIG. 7) is fitted from the anterior with a hood H of the corresponding connector C. However, the anterior edge of the lower face 25 of the electric wire cover 20 extends to a position close to the tip of the hood H. That is, the lower face of the housing 10 is used effectively and without wastage to form the wire distribution space 36L, which thereby has an adequate length in an anterior-posterior direction.

In this manner, the anterior-posterior length of the present embodiment adequately maintains the wire distribution space 36L. As a result, if the pressure contact portion of the electric wires 35 were severed at a lower level, and the severed end 35A were housed within the wire distribution space 36L, even if separation were taking place along the length of the severed end 35A, the severed end 35A could reliably be housed within the wire distribution space 36L. Consequently, the conductor exposed at the severed end face is prevented from making contact with foreign objects.

Further, a protrusion 18 is formed between the tip of the hood H and the anterior end of the wire distribution space 36L, this protrusion 18 corresponding to the severed end 35A. As a result, contact with foreign objects can be prevented effectively.

As mentioned in the introduction, walls 41 are provided on either side of the locking arm 12 to prevent inadvertent release thereof. In a second aspect of this invention, the walls 41 are cut-away along with adjacent portions of the wire guiding walls 23 of the cover 20. These cut-away portions include a chamfer 42 of the walls 41, and a chamfer 43 and horizontal portion 45 of the walls 23.

The cut-away portion is just sufficient to allow a finger to depress the locking arm 12. However the walls 41,23 remain so as to prevent, as much as possible, inadvertent release of the locking arm, and to provide guidance for the electric wire(s). The cut-away portion can best be seen in FIG. 8, which also shows a latch member 44 of the locking arm 12.

The cut-away portion is provided on both the housing 10 and the cover 20 so as to give access to the locking arm 12 even when it is close to the cover. Furthermore, as illustrate in FIG. 8, the cut-away portion of the cover is separated from the path of the wire so as to prevent interference between a finger and the wire.

The present invention is not limited to the embodiments described above with the aid of figures. For example, the possibilities described below also lie within the technical range of the present invention. In addition, the present invention may be embodies in various other ways without deviating from the scope thereof.

In the present embodiments, the ribs are provided only on the upper face of the housing and the lower face of the electric wire cover. However, the ribs may be provided only on the lower face of the housing and he upper face of the cover, or provided on the upper and lower faces of the housing and the upper and lower faces of the electric wire cover.

In the present embodiments, one electric wire each is partitioned in the wire distribution spaces by the ribs. However, according to the present invention, it need not be the case that only one electric wire is partitioned in each distribution space by the ribs.

In the present embodiments, an explanation has been given in which the number of terminal fittings is two. However, the present invention is equally suitable in the case where the number of terminal fittings is three or more.

Although the cut-away portion is separate from the electric wire path, it could be coincident therewith. Needless to say, the cut-away portion could be in the form of an arc or other suitable shape.

What is claimed is:

1. An electrical connector comprising a housing, a terminal fitting within said housing and having a protruding end for engagement with an electrical wire, a cover for said protruding end, said cover and housing being fitted together in an axial direction with respect to one another, a first rib on an external surface of said housing defining one of an upper and a lower wire distribution space between said cover and said housing, and a second rib on said cover defining the other of said upper and lower wire distribution spaces, wherein said rib of said cover is provided on an external surface of said cover, wherein said first and second ribs are oriented to separate adjacent wires and prevent said cover being fitted upside down on said housing, and wherein said cover includes a planar projection extending towards said housing and adapted to overlap the rib of said housing to define a wire distribution channel.

2. A connector according to claim 1 wherein said cover includes external upstanding walls to define a guiding channel for one or more electrical wires.

3. A connector according to claim 2 and having a plurality of terminal fittings each being for engagement with a respective wire, said ribs defining respective wire distribution spaces on either side thereof.

4. A connector according to claim 3 and including a plurality of ribs on one of said cover and housing.

5. A connector according to claim 3 wherein said cover includes a planar projection extending towards said housing, and adapted to overlap the rib of said housing to define a wire distribution channel.

6. An electrical connector comprising a housing, a plurality of terminal fittings within said housing each having a protruding end for engagement with an electrical wire, a cover for said protruding end, said cover and housing being fitted together in an axial direction with respect to one another, a first rib on an external surface of said housing defining one of an upper and a lower wire distribution space between said cover and said housing, and a second rib on said cover defining the other of said upper and lower wire distribution spaces, wherein said rib of said cover is provided on an external surface of said cover, and wherein said first and second ribs are oriented to separate adjacent wires and prevent said cover being fitted upside down on said housing, wherein said ribs define respective wire distribution spaces on either side thereof, and wherein a plurality of ribs are provided on both said cover and housing.

7. An electrical connector comprising a housing, a resilient cantilevered locking arm of the housing having a protrusion engageable with an abutment of a mating connector, a terminal fitting within said housing and having a protruding end for engagement with an electrical wire, a cover for said protruding end, said cover having upstanding walls on either side of said arm to prevent accidental depression thereof, said walls including a cut-away portion just sufficient to permit depression of said locking arm by a single finger, said cover and housing being fitted together in an axial direction with respect to one another, a first rib on an external surface of said housing defining one of an upper and a lower wire distribution space between said cover and said housing, and a second rib on said cover defining the other of sad upper and lower wire distribution spaces, wherein said first and second ribs are oriented to separate adjacent wires and prevent said cover being fitted upside down on said housing.

8. A connector according to claim 7 wherein said housing also has upstanding walls to either side of said arm to prevent accidental depression thereof, said walls of said housing and cover having adjacent cut-away portions just sufficient to permit depression of said locking arm by a single finger.

9. A connector according to claim 7 wherein said rib of said cover is provided on an external surface of said cover.

10. A connector according to claim 9 wherein said cover includes a planar projection extending towards said housing, and adapted to overlap the rib of said housing to define a wire distribution channel.

11. A connector according to claim 7 wherein said upstanding walls of said cover extend away from said locking arm to define a guiding channel for one or more electrical wires.

12. A connector according to claim 11 wherein said housing also has upstanding walls to either side of said arm to prevent accidental depression thereof, said walls of said housing and cover having adjacent cut-away portions just sufficient to permit depression of said locking arm by a single finger.

13. An electrical connector comprising:

a housing, said housing having a resilient cantilevered locking arm, the locking arm having a protrusion engageable with an abutment of a mating connector;

a terminal fitting within said housing and having a protruding end for engagement with an electrical wire;

a cover fit together with the housing to cover said protruding end;

a pair of upstanding walls on each of said housing and said cover and extending along either side of said locking arm to prevent accidental depression of said locking arm;

a cut-away portion on said upstanding walls of said cover to form a portion of the upstanding wall on the cover with a reduced height adjacent the locking arm; and a cut-away portion on said upstanding walls of said housing to form a portion of said upstanding wall on the housing with a reduced height adjacent the cutaway portion of the cover, said cut-away portions of said cover and said housing being cut-away an amount sufficient to permit depression of said locking arm by a single finger.

* * * * *